US005936538A

United States Patent [19]

Meschkow et al.

[11] Patent Number: 5,936,538

[45] Date of Patent: Aug. 10, 1999

[54] SHOELACE WARNING SYSTEM

[76] Inventors: Sasha H. Meschkow; Jordan M. Meschkow, both of 6105 E. Paradise La., Scottsdale, Ariz. 85254

[21] Appl. No.: 09/161,785

[22] Filed: Sep. 28, 1998

[51] Int. Cl.[6] ..... G08B 21/00

[52] U.S. Cl. ..... 340/687; 340/573.1; 340/665; 24/712

[58] Field of Search ..... 340/573.1, 687, 340/686.1, 691.1, 691.6, 692, 665, 666, 668; 24/712

[56] References Cited

U.S. PATENT DOCUMENTS

| | | | |
|---|---|---|---|
| 3,898,641 | 8/1975 | Banner | 340/687 |
| 5,430,621 | 7/1995 | Raskas | 362/32 |
| 5,718,021 | 2/1998 | Tatum | 24/712.2 |
| 5,778,499 | 7/1998 | Lehrman | 24/713 |

*Primary Examiner*—Nina Tong
*Attorney, Agent, or Firm*—Meschkow & Gresham, P.L.C.; Jordan M. Meschkow; Lowell W. Gresham

[57] ABSTRACT

An untied shoelace warning system with first and second conductive shoelace segments coupled to an indicator that activates when the shoelace segments do not touch, and does not activate when the shoelace segments do touch. The first and second conductive shoelace segments and the indicator are coupled to a battery and a switch. The switch activates the indicator when the shoelace segments are not touching, and does not activate the indicator when the shoelace segments are touching. The untied shoelace warning system further includes a pressure sensor so that when the pressure sensor does not sense pressure and the first and second conductive shoelace segments coupled to an indicator are not touching, the indicator does not activate. The untied shoelace warning system does not activate the indicator when the shoe that is tied with the first and second shoelace segments is not being worn. The indicator may be a sound device, e.g., a piezoelectric buzzer, a light or a series of lights, e.g., light emitting diodes or LED's, a vibrating device, or a combination of the aforementioned devices. The switch may be a relay, a transistor, a Darlington amplifier, or a microprocessor.

14 Claims, 3 Drawing Sheets

SHOELACE WARNING SYSTEM

TECHNICAL FIELD OF THE INVENTION

The invention relates to a shoelace warning system, particularly one that warns when shoelaces are untied, and therefore called herein an untied shoelace warning system.

More particularly, the invention relates to a shoelace warning system that warns when shoelaces are untied while a shoe the shoelace is laced thereon is worn by a user.

Still more particularly, the invention relates to a shoelace warning system that warns when shoelaces are untied while a shoe the shoelace is laced thereon is worn by a user because the shoelace warning system further comprises a pressure sensor positioned within the shoe to sense when the shoe is worn by a user.

BACKGROUND OF THE INVENTION

Walking in shoes with untied shoelaces can be a very dangerous activity. Many injuries per year are inflicted on people that while walking in shoes with untied laces, stepped on the laces, and thereby tripped and/or fell. Resulting injuries range from small cuts or bruises to broken bones or even a head injury.

Another problem with untied shoelaces is that stepping on them damages the lace ends. This occurs even if stumbling, falling, or injury does not result. This allows the lace to unravel which causes it to ruin, especially if the lace falls back from the last eyelet in the shoe. Re-inserting the lace end through the eyelet may not be possible.

Shoelaces are laced into shoes of all kinds and styles. No matter what the kind or style, however, shoelaces often come untied. Few people notice an untied shoelace until injury or damage to the lace has occurred.

Untied shoelaces are particularly prevalent with young children and their shoes. A young child may be between five and eight years old before they may effectively tie their shoelaces. Double-knotting shoelaces and shoes with hook-and-loop fasteners are employed to remedy the young child's lack of ability. Yet even double-knotted shoelaces come untied, and a young one that can only tie shoes ineffectively, causes the lace to be untied again later.

The young child rarely notices an untied lace and even if he or she does, usually cannot tie the shoelace him- or her-self. Unaware of the problems and dangers of untied shoelaces, the child never asks an adult for assistance. Injury to the child or ruin to the shoelace is highly likely to occur.

SUMMARY OF THE INVENTION

Accordingly an advantage of the present invention is that an untied shoelace warning system with first and second conductive shoelace segments coupled to an indicator that does not activate when the segments are touching is provided.

Another advantage of the present invention is that the untied shoelace warning system with first and second conductive shoelace segments coupled to an indicator will activate the indicator when the segments are not touching.

Yet another advantage of the present invention is that the untied shoelace warning system can include a pressure sensor so that when the pressure switch does not sense pressure and the first and second conductive shoelace segments coupled to an indicator are not touching, the indicator does not activate.

The above and other advantages of the present invention are carried out in one form by an untied shoelace warning system with first and second conductive shoelace segments coupled to an indicator that activates when the shoelace segments do not touch, and does not activate when the shoelace segments do touch. The first and second conductive shoelace segments, and the indicator are coupled to a battery and a switch. The switch activates the indicator when the shoelace segments are not touching, and does not activate the indicator when the shoelace segments are touching.

The above and other advantages of the present invention are carried out in another form by an untied shoelace warning system described as above, further comprising a pressure sensor so that when the pressure sensor does not sense pressure and the first and second conductive shoelace segments coupled to an indicator are not touching, the indicator does not activate. In this embodiment the untied shoelace warning system does not activate the indicator when the shoe that is tied with the first and second shoelace segments is not being worn.

The indicator may be a sound device, e.g., a piezoelectric buzzer, a light or a series of lights, e.g., light emitting diodes or LED's, a vibrating device, or a combination of the aforementioned devices. The switch may be a relay, a transistor, a Darlington amplifier, or a microprocessor. A capacitor or timer may be employed between the first and second conductive shoelace segments and the switch to prevent the indicator from activating during short, intermittent disconnects between first and second conductive shoelace segments.

The present invention may be incorporated into a shoe, or sold as kit used to retrofit shoes. The kit comprises two new shoelaces to lace into a pair of shoes, coupled to a battery, a switch, and an indicator.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
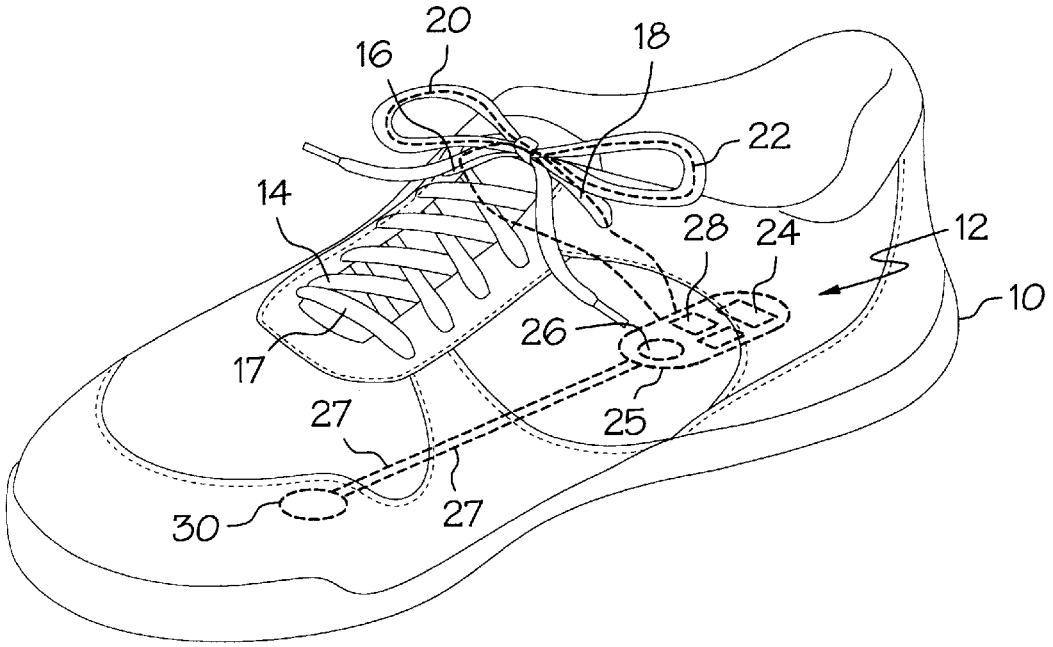
FIG. 1 shows a perspective view of a shoe with the shoelace warning system installed.

FIG. 1 shows shoe 10 with shoelace warning system 12 installed. As shown, shoelace warning system 12 has shoelace 14 with first conductive shoelace segment 16 and second conductive shoelace segments 18. Segment 16 has conductive elements 20 and segment 18 has conductive elements 22. Shoelace 14 also has non-conductive segment 17 between segments 16 and 18. Segment 17 insulates segment 16 from segment 18. With shoelace 14 shown tied, at least one of elements 20 is in contact with at least one of elements 22.

Segments 16 and 18 are coupled to an indicator 24 that activates when the segments 16 and 18 do not touch, and does not activate when segments 16 and 18 do touch. Segments 16 and 18, and indicator 24 are coupled to battery 26 and switch 28. Switch 28 activates indicator 24 when the segments 16 and 18 are not touching because in this state none of elements 20 are in contact with any of elements 22. Switch 28 does not activate indicator 24 when the segments 16 and 18 are touching, because in this state, at least one of elements 20 is in contact with at least one of elements 22. Switch 28 may be a relay, a transistor, a Darlington amplifier, or even a microprocessor.

Pressure sensor 30 is mounted on top of or below the inside sole of shoe 10. Pressure sensor 30 is generally wired between one of segments 16 or 18 and switch 28. In this way, when pressure sensor 30 does not sense pressure and segments 16 and 18 are not touching, indicator 24 does not activate.

Without pressure sensor 30, shoelace warning system 12 would sound, light-up, and/or vibrate when not worn because lace 14 is not generally tied when shoe 10 is off the wearer's foot. Alternatively, an on/off switch (not shown) may be employed to disengage system 12 when shoe 10 is not worn.

Switch 28, battery 26, indicator 24, and other components for shoelace warning system 12 can be housed within module 25. Module 25 is mounted in a convenient location within shoe 10. Wires from segments 16 and 18 (not shown) connect these segments to module 25. Wires 27 connect pressure sensor 30 to module 25.

Figure 2:
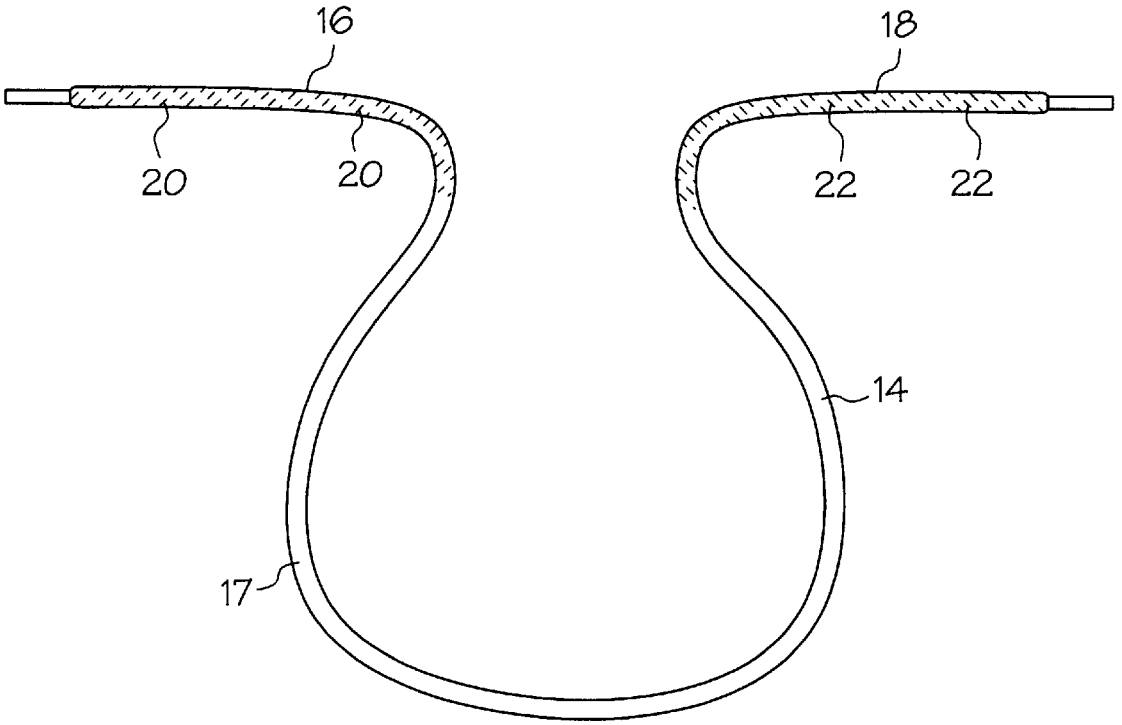
FIG. 2 shows a shoelace with conductive shoelace segments.

Shoelace 14, as shown in FIG. 2 has segments 16, 17 and 18. Segment 16 has conductive elements 20 and segment 18 has conductive elements 22, which may be wires woven through the mesh pattern of a standard shoelace, an elastomeric strand woven through the shoelace, or a conductive coating (not shown) applied to segments 16 and 18. Weaving conductive elements 20 and 22 through segments 16 and 18 of shoelace 14, or coating segments 16 and 18 with conductive, will ensure that at least one of elements 20 will come in contact with any of elements 22 when shoelace 14 is tied. Segment 17 is non-conductive so as to insulate segment 16 from segment 18.

Figure 3:
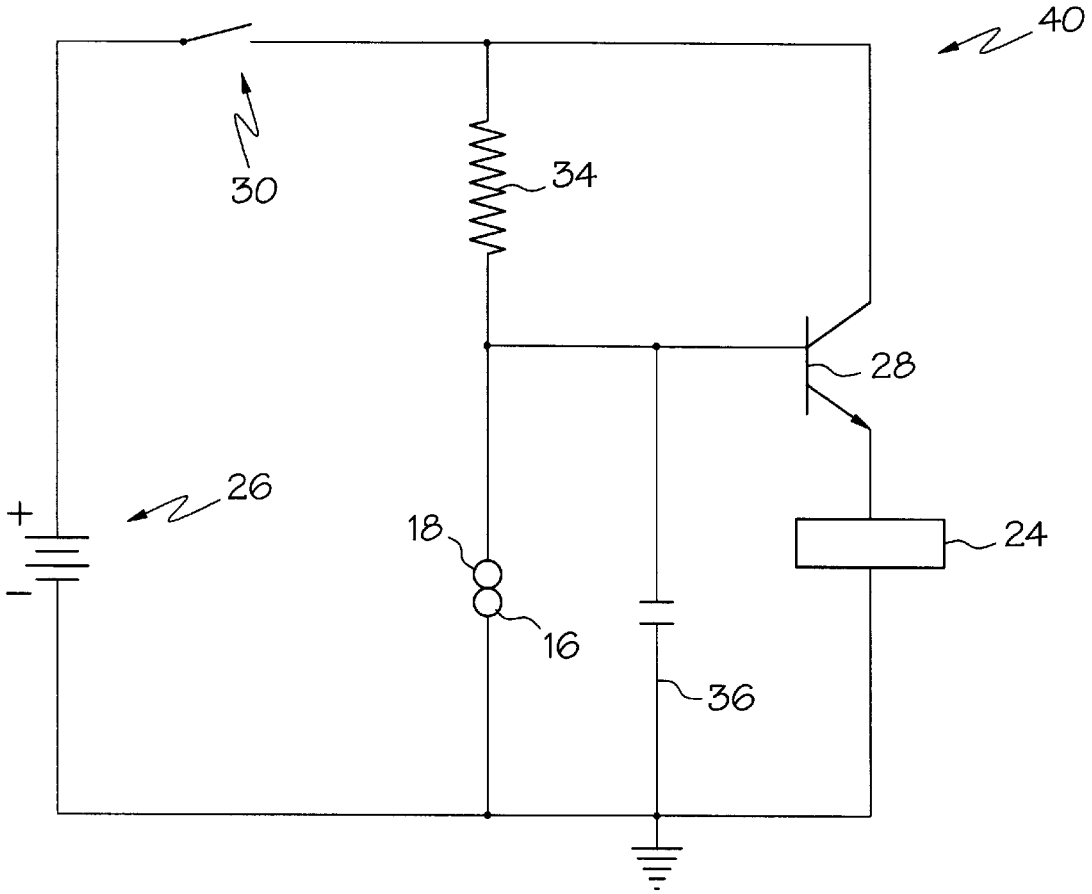
FIG. 3 shows a first circuit for the shoelace warning system using a transistor or a Darlington amplifier

FIG. 3 shows transistor circuit 40 with battery 26, pressure sensor 30, segment 18, and a resistor 34 coupled to the input terminals of transistor 28, while segment 16 and indicator 24 are coupled to the output terminals of transistor 28. Transistor circuit 40, using a transistor for switch 28 may provide 100 times or more amplification, sufficient to drive indicator 24, if it is a piezoelectric buzzer.

Where indicator 24 requires more power to drive it, such as in the case of a light or a series of lights, e.g., light emitting diodes or LED's, a vibrating device, or a combination of the buzzer and/or the aforementioned devices, switch 28 may be a Darlington amplifier.

Transistor circuit 40, using a Darlington amplifier for switch 28 may provide 10,000 times or more amplification, sufficient to drive indicator 24 as a piezoelectric buzzer, a light or a series of lights, e.g., light emitting diodes or LED's, a vibrating device, or a combination of these devices.

Circuit 40 may further include resistor 34 between pressure switch 30 and shoelace segment 18 to lower the current to segment 18, and also may optionally include a timer or capacitor 36 to prevent indicator 24 from activating during short, intermittent disconnects between shoelace segments 16 and 18.

Figure 4:
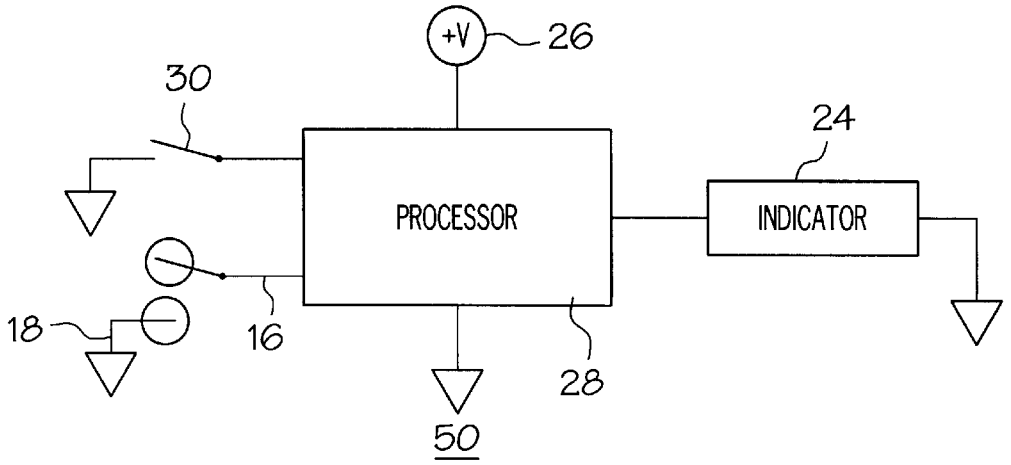
FIG. 4 shows a second circuit for the shoelace warning system, using a microprocessor.

To make shoelace warning system more compact a microprocessor circuit may be used. FIG. 4 shows microprocessor circuit 50 with a microprocessor as switch 28 having pins for battery or power 26 and ground, another pin for pressure sensor 30, which goes to ground, another pin to connect indicator 24, which goes to ground, another pin to connect one of segments 16 or 18, while the other of segments 16 or 18 goes to ground.

Figure 5:
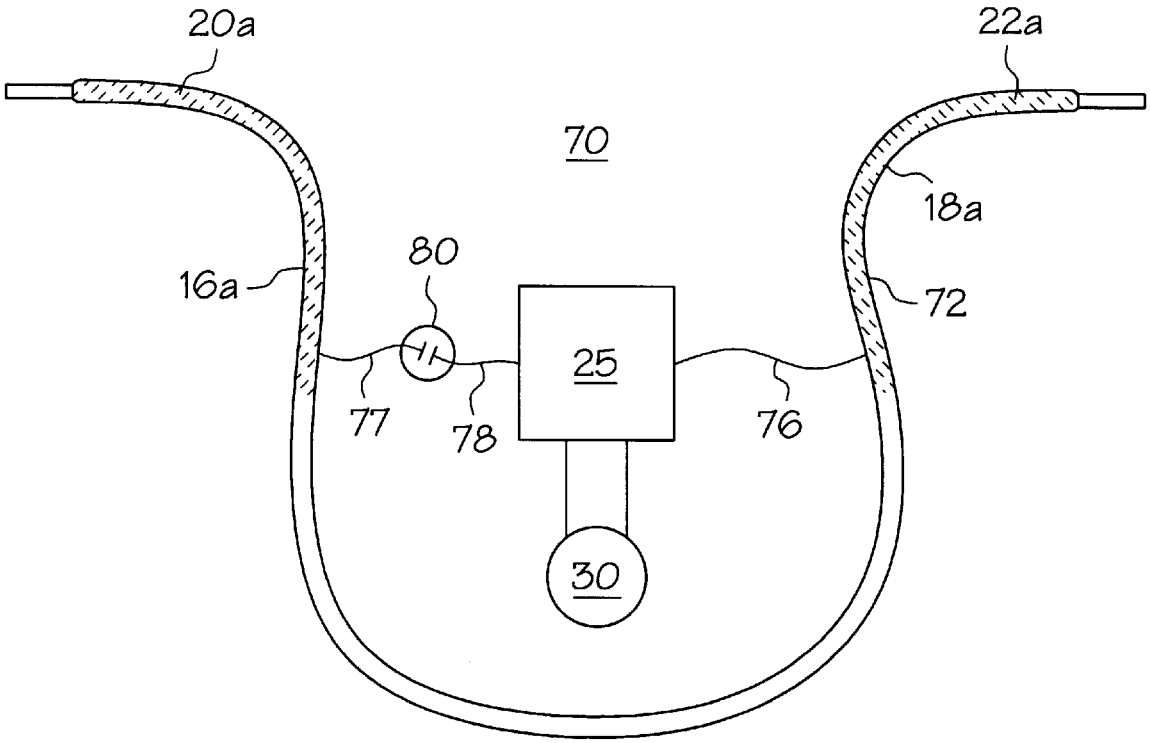
FIG. 5 shows the shoelace warning system in kit form.

FIG. 5 shows shoelace warning kit 70. Kit 70 may be sold to retrofit existing shoes with shoelace warning system 12.

Kit 70 has shoelace 72, which has shoelace segments 16*a* and 18*a*. Each of segments 16*a* and 18*a* carry conductive coating portions 20*a* and 22*a*. Conductive portion 22*a* of segment 18*a* is coupled to module 25 by way of wire 76. Within module 25 is battery 26 and switch 28 (not shown here). Indicator 24 may be housed in module 25, or can be external (not shown).

One side of module 25 must be separable from either segment 16*a* or 18*a* for purposes of lacing lace 72 into a shoe. Once so laced, for example, segment 16*a* may be connected to module 25 by connecting wire portion 77 to wire portion 78 via connector 80. Connector 80 may be a push-in quick connector, for ease of installation. Finally pressure sensor 30 is mounted on the top of the inside sole, or under the inside sole.

In summary, the present invention provides a shoelace warning system comprising a shoelace with first and second conductive portions where the lace is tied, a battery, a switch, and an indicator that activates when the shoelace segments do not touch, and does not activate when the shoelace segments do touch. In addition, a pressure sensor may be employed so that when the pressure sensor does not sense pressure and the first and second conductive shoelace segments coupled to an indicator are not touching, the indicator does not activate. Here, the untied shoelace warning system does not activate the indicator when the shoe that is tied with the first and second shoelace segments is not being worn.

Although the preferred embodiments of the invention have been illustrated and described in detail, it will be readily apparent to those skilled in the art that various modifications may be made therein without departing from the spirit of the invention or from the scope of the appended claims. For example, various indicators or switches may be used, and different wiring schemes can be adopted. Even different batteries or power devices can be adapted.

Having disclosed my invention such that anyone skilled in art could make the invention from this disclosure, I claim:

1. A shoelace warning system comprising:

A battery;

A first conductive shoelace segment;

A second conductive shoelace segment;

An indicator; and

Switching means;

Said first shoelace segment, said second shoelace segment, said indicator and said switching means coupled to said battery, so that when said first and second shoelace segments are touching, said indicator does not activate, and when said first and second shoelace segments are not touching said indicator activates.

2. The shoelace warning system of claim 1 further including pressure sensor means coupled to said battery so that when said first and second shoelace segments are not touching, and said sensor means senses pressure, said indicator activates.

3. The shoelace warning system of claim 1 further including pressure sensor means coupled to said battery so that when said first and second shoelace segments are not touching, and said sensor means does not sense pressure, said indicator does not activate.

4. The shoelace warning system of claim 1 wherein said indicator is selected from sound means, light means, and vibrating means.

5. The shoelace warning system of claim 1 wherein said switching means is a transistor.

6. The shoelace warning system of claim 1 wherein said switching means is a microprocessor.

7. The shoelace warning system of claim 1 wherein said indictor is a piezoelectric buzzer.

8. The shoelace warning system of claim 1 wherein switching means is coupled between said first shoelace segment and said indicator.

9. The shoelace warning system of claim 8 further including a timer coupled between said first and second shoelace segments and said indicator.

10. The shoelace warning system of claim 8 wherein said shoelace has a non-conductive central portion separating said first and second shoelace segments.

11. The shoelace warning system of claim 1 wherein said first and second shoelace segments are part of a shoelace.

12. The shoelace warning system of claim 1 wherein said first and second shoelace segments are conductive by way of conductive material being applied to said first and second shoelace segments.

13. The shoelace warning system of claim 1 wherein said first and second shoelace segments are conductive by way of conductive material being woven into said first and second shoelace segments.

14. A shoelace warning system comprising a battery, a first conductive shoelace segment, a second conductive shoelace segment, an indicator; and a switch; Said first shoelace segment, said second shoelace segment, said indicator and said switch coupled to said battery, so that when said first and second shoelace segments are touching, said indicator does not activate, and when said first and second shoelace segments are not touching said indicator activates.

* * * * *